US007611372B2

(12) United States Patent
Shen et al.

(10) Patent No.: US 7,611,372 B2
(45) Date of Patent: Nov. 3, 2009

(54) ROTATABLY LOCKING PLUG AND CONNECTOR

(75) Inventors: Raymond Shen, Peachtree City, GA (US); Brian Paul Balmes, Fayetteville, GA (US); Christian David Baker, Peachtree City, GA (US); Andree Michelle Chiasson, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/131,040

(22) Filed: May 31, 2008

(65) Prior Publication Data

US 2009/0029585 A1 Jan. 29, 2009

Related U.S. Application Data

(60) Provisional application No. 60/932,684, filed on May 31, 2007.

(51) Int. Cl.
*H01R 13/62* (2006.01)

(52) U.S. Cl. ..... 439/372

(58) Field of Classification Search ..... 439/372, 439/351–357

See application file for complete search history.

(56) References Cited

U.S. PATENT DOCUMENTS

| | | | | |
|---|---|---|---|---|
| 2,324,738 | A | 7/1943 | Stieglitz | |
| 2,415,357 | A | 2/1947 | Kucki | |
| 3,334,770 | A | 8/1967 | Harris | |
| 3,477,609 | A | 11/1969 | Winkler | |
| 4,079,880 | A | 3/1978 | Edwards | |
| 4,211,467 | A * | 7/1980 | Cross et al. | 385/16 |
| 4,531,798 | A * | 7/1985 | Baur et al. | 439/368 |
| 4,875,318 | A | 10/1989 | MacLeod et al. | |
| D306,583 | S | 3/1990 | Krolopp et al. | |
| 4,920,708 | A | 5/1990 | MacLeod et al. | |
| 5,326,060 | A | 7/1994 | Chubb et al. | |
| 5,456,377 | A | 10/1995 | Williams | |
| 5,549,266 | A | 8/1996 | Mitchell et al. | |
| 5,722,208 | A | 3/1998 | Humphrey et al. | |
| 5,993,239 | A * | 11/1999 | Wright | 439/357 |
| D419,966 | S | 2/2000 | Mowery et al. | |
| 6,051,786 | A | 4/2000 | Gretz | |

(Continued)

OTHER PUBLICATIONS

U.S. Appl. No. 12/103,644, Shen et al.

(Continued)

*Primary Examiner*—Briggitte R Hammond
(74) *Attorney, Agent, or Firm*—King & Spalding LLP

(57) ABSTRACT

An apparatus for coupling an electrical connector to a cable is provided. The apparatus includes an electrical connector having at least one tab extending radially out from the electrical connector and a housing rotatably coupled to the electrical connector. The housing includes at least one first channel disposed along an interior of the housing, wherein the at least one tab is configured to slidably engage the first channel. The housing also includes a spacer applying a first force in a first direction to the electrical connector. The housing also includes at least one tab retention member disposed along the interior of the housing, wherein the tab retention member is annularly disposed from the first channel and prevents the electrical connector from traveling beyond a predetermined distance in the first direction.

19 Claims, 10 Drawing Sheets

U.S. PATENT DOCUMENTS

| | | | | |
|---|---|---|---|---|
| 6,203,349 | B1 * | 3/2001 | Nakazawa | 439/319 |
| 6,268,563 | B1 | 7/2001 | Gretz | |
| D450,665 | S | 11/2001 | Isely et al. | |
| 6,355,882 | B1 | 3/2002 | Gretz | |
| 6,806,426 | B1 | 10/2004 | Gretz | |
| D499,330 | S | 12/2004 | Peato | |
| 6,956,171 | B1 | 10/2005 | Gretz | |
| 6,965,078 | B1 | 11/2005 | Gretz | |
| 7,005,578 | B2 | 2/2006 | Gretz | |
| D566,657 | S | 4/2008 | Shen et al. | |
| 2007/0261872 | A1 | 11/2007 | Schieta et al. | |

OTHER PUBLICATIONS

U.S. Appl. No. 29/288,186, Shen et al.

* cited by examiner

ROTATABLY LOCKING PLUG AND CONNECTOR

RELATED APPLICATIONS

This patent application claims priority under 35 U.S.C. § 119 to U.S. Provisional Patent Application No. 60/932,684, titled "Rotatably Locking Plug And Connector," filed May 31, 2007. The complete disclosure of the above-identified priority application is hereby fully incorporated herein by reference.

TECHNICAL FIELD

The present invention relates generally to wiring devices, and more specifically to connectors for coupling conductors to electrical connectors.

BACKGROUND OF THE INVENTION

The use of plugs and receptacles (collectively referred to as "electrical connectors") to provide electrical connections between devices or between devices and sources of electrical power is well known in the art. In a conventional configuration, plugs are "male" adapters that form an electrical connection with "female" receptacles. Conventional plugs can include a variety of configurations of male adapters, often referred to as "blades" or "contact blades." Conventional receptacles are configured with "female" connection points that correspond to the blades of a plug that will be used with the receptacle.

Despite the many variations of electrical connectors, a common feature of all connectors is that they must be coupled to an electrical conductor that delivers electricity from the electrical connector to the device. Conventionally, the conductor is a wire or cable that is appropriate for a given application.

In some applications, such as industrial applications, the electrical connector is subject to harsh conditions, yet must remain connected to the conductor. The conventional solution to this problem is to place the connector in a housing that provides protection to the connection point between the conductor and the electrical connector. Conventional housings are coupled to the electrical connector via threads on the housing (and corresponding threads on the electrical connector), or are screwed or fused to the electrical connector. While these conventional coupling mechanisms provide a secure connection between the housing and the electrical connector, they are difficult, if not impossible, to replace on a working job site. Accordingly, if an electrical connector is damaged in a working environment, replacing the connector requires an inordinate amount of time and energy. Furthermore, work will often be stopped while waiting for the connection to be repaired.

Accordingly, a need exists in the art for a system that provides a housing for an electrical connector that can be quickly removed and replaced, yet provides secure protection for the electrical connector and the connection between the connector and its respective conductor.

SUMMARY OF THE INVENTION

The present invention satisfies the above-described needs by providing a rotatably locking plug and connector. In one aspect, the present invention provides an apparatus for coupling an electrical connector to a cable. The apparatus can include an electrical connector having at least one tab extending radially out from the electrical connector. The apparatus can also include a housing rotatably coupled to the electrical connector. The housing can include at least one first channel disposed along an interior of the housing, wherein the at least one tab is configured to slidably engage the first channel. The housing can include a spacer applying a first force in a first direction to the electrical connector, and at least one tab retention member disposed along the interior of the housing, wherein the tab retention member is annularly disposed from the first channel and prevents the electrical connector from traveling beyond a predetermined distance in the first direction. The housing can also include at least one second channel for slidably receiving the at least one tab, the second channel transverse the first channel and the tab retention member, wherein a second force can be applied in a second direction for each of the at least one tabs to transition from the first channel to the second channel, and wherein the first force applied by the spacer holds the electrical connector in place against the tab retention member.

In another aspect, the present invention provides a method for coupling an electrical connector to a cable, which can include providing a housing configured to receive an electrical connector. The housing can include a spacer applying a first force in a first direction, a first channel disposed along an interior of the housing, a tab retention member disposed along the interior of the housing, and a second channel transverse the first channel and the tab retention member. The method can also include providing an electrical connector comprising a tab. The tab can be aligned with the first channel. The tab can then be slidably moved in the first channel in a second direction. A second force can be applied in the second direction on the electrical connector, the second force displacing the spacer in the second direction and providing access to the second channel. The tab can then be rotated in a first direction along the second channel into alignment with the tab retention member. The second force on the electrical connector can be reduced, and the tab can be displaced in the first direction and into contact with the tab retention member.

In yet another aspect, a system is provided for protecting an electrical coupling between an electrical connector and a conductor. The system can include a housing configured to protect the electrical coupling. The housing can include a spacer that includes a spring configured to apply a force in a first direction against the electrical connector. The housing can also include a locking ring configured to prevent the electrical connector from passing into the housing. The housing can also include a channel in the locking ring configured to allow the electrical connector to pass into the housing when the electrical connector is disposed in a first orientation with respect to the housing. The housing can also include a retention member in the locking ring configured to hold the electrical connector within the housing when the electrical connector is disposed in a second orientation with respect to the housing.

Additional aspects, objects, features, and advantages of the invention will become apparent to those having ordinary skill in the art upon consideration of the following detailed description of illustrated embodiments. For a more complete understanding of the exemplary embodiments of the present invention and the advantages thereof, reference is now made to the following description in conjunction with the accompanying drawings described below.

BRIEF DESCRIPTION OF THE DRAWINGS

For a more complete understanding of the exemplary embodiments of the present invention and the advantages thereof, reference is now made to the following description in conjunction with the accompanying figures briefly described as follows.

DETAILED DESCRIPTION OF THE EXEMPLARY EMBODIMENTS

Figure 1A:
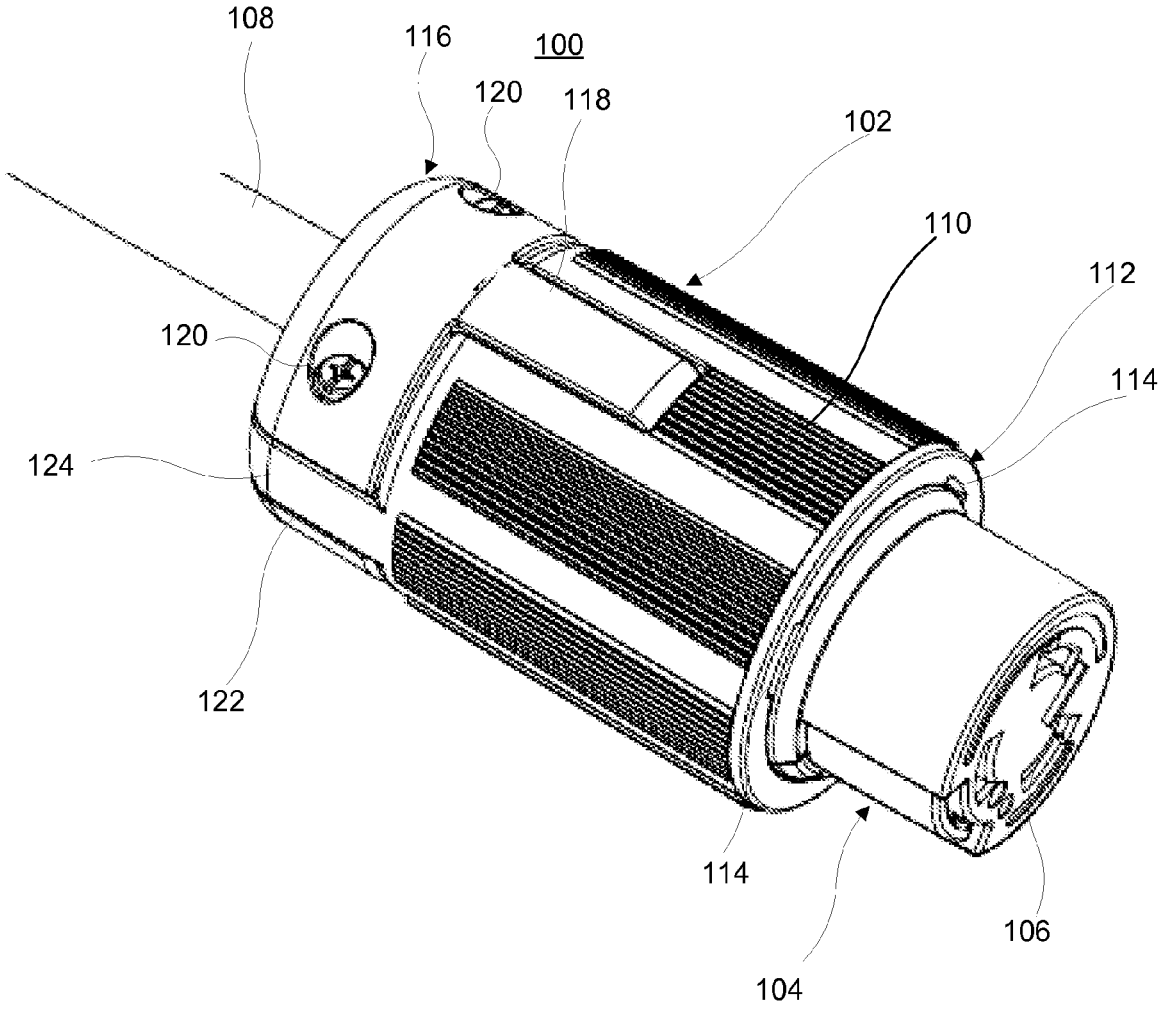
FIG. 1*a* is a perspective view of a rotatably locking plug connector according to certain exemplary embodiments of the present invention.

The present invention provides a rotatably locking plug connector for protecting the coupling between an electrical conductor and an electrical connector. The rotatably locking plug connector includes a spring-loaded spacer that exerts a force in the direction of the electrical connector. The electrical connector, which has a number of protruding tabs, is inserted into the housing of the rotatably locking plug connector. By compressing the spring-loaded spacer, a channel is opened that allows the electrical connector to be rotated within the housing, and into a position such that the tabs are aligned with tab retention members disposed within the housing. By subsequently releasing the electrical connector, the spring-loaded spacer decompresses, forcing the tabs against the tab retention members, and holding the electrical connector firmly in place within the housing. By the same token, compressing the spring-loaded spacer and rotating the electrical connector in the opposite direction causes the tabs to disengage from the tab retention members, allowing the electrical connector to be easily removed from the housing.

The term "electrical connector" refers generally to a male, female, or hermaphroditic connector that facilitates the connection between two or more connectors. The term "plug" generally refers to a male electrical connector. The term "receptacle" generally refers to a female electrical connector. The terms "cable," "wire," and "electrical cable" may be used interchangeably, and refer generally to an electrical conductor capable of facilitating the flow of electrons from one location to another. Any spatial references herein such as, for example, "upper," "lower," "above," "below," "rear," "between," "vertical," "angular," "beneath," "rotational," etc., are for the purpose of illustration only and do not limit the specific orientation or location of the described structure.

Referring now to the figures, in which like numerals represent like elements throughout the figures, exemplary embodiments of the present invention will be described. FIG. 1 is a perspective view of a rotatably locking plug connector 100 according to certain exemplary embodiments of the present invention. Referring now to FIG. 1, the exemplary connector 100 includes a housing 102 that surrounds and protects the coupling between a conductor 108 and an electrical connector 104. In one exemplary embodiment, the electrical connector 104 is a plug or receptacle configured according to National Electrical Manufacturer's Association ("NEMA") standards, such as a NEMA L6 plug or receptacle. In an alternative embodiment, the electrical connector 104 can be any plug, receptacle, or connector configured to facilitate a connection between two or more conductors. The conductor 108 is a cable capable of transmitting electrical power from one location to another, such as, but not limited to, a three-conductor or four-conductor cable.

In one exemplary embodiment, the housing 102 is substantially cylindrical in shape, and is an appropriate size to fit around the electrical connector 104. In one exemplary embodiment, the housing 102 is formed from impact resistant nylon, and has a number of ridges 110 running longitudinally along its exterior to provide additional traction to aid gripping of the housing 102. In an alternative embodiment, the housing 102 can be formed from any material having the properties of an electrical insulator that is also sufficiently lightweight and impact resistant to be used in an industrial workplace.

The housing 102 includes a locking ring 112 configured with channels 114 to allow the electrical connector 104 to be inserted into the housing 102, and also to secure the electrical connector 104 in the housing 102 when the electrical connector 104 has been rotated into place. In one exemplary embodiment, the locking ring 112 is formed from the same impact-resistant nylon as the housing 102, and is fused to the housing 102 using conventional methods, such as ultrasonic welding, chemical fusing, or other methods of fusing materials that are appropriate for the material chosen for the housing 102 and the locking ring 112. Additional features of the locking ring 112 will be discussed in further detail below with respect to FIGS. 6 and 7.

The housing 102 also includes a locking member 116 and a cable lock 122. The locking member 116 and the cable lock 122 are disposed on the end of the housing 102 opposite the electrical connector 104, and are typically shaped to conform to the shape of the housing 102. The locking member 116 includes a locking tab 118 that extends into the housing 102 and assists in holding the electrical connector 104 in place once the electrical connector 104 is rotatably inserted into the housing 102. The locking tab 118 extends along a depression 132 (in FIG. 1*a*) in the side of the housing 102 that allows the locking tab 118 to lay substantially flush with the exterior of the housing 102 when the locking member 116 is engaged with the housing 102. When the locking member 116 is coupled to the cable lock 122, a clamping force is applied to the conductor 108, holding it in place and reducing tension on the connection between the conductor 108 and the electrical connector 104.

The locking member 116 has fastener openings 120 that are configured to accept fasteners for coupling the locking member 116 to the cable lock 122. The cable lock 122 has fastener openings 126 that correspond to the fastener openings 120 of the locking member 116. In one exemplary embodiment, the fasteners used to couple the locking member 116 to the cable lock 122 are screws, although any fastener suitable for firmly coupling the locking member 116 to the cable lock 122 can be used. When the locking member 116 and the cable lock 122 are coupled together, they are further supported by and provide a compression force against lock support members 124 that extend longitudinally from the housing 102 along its exterior.

Figure 1B:
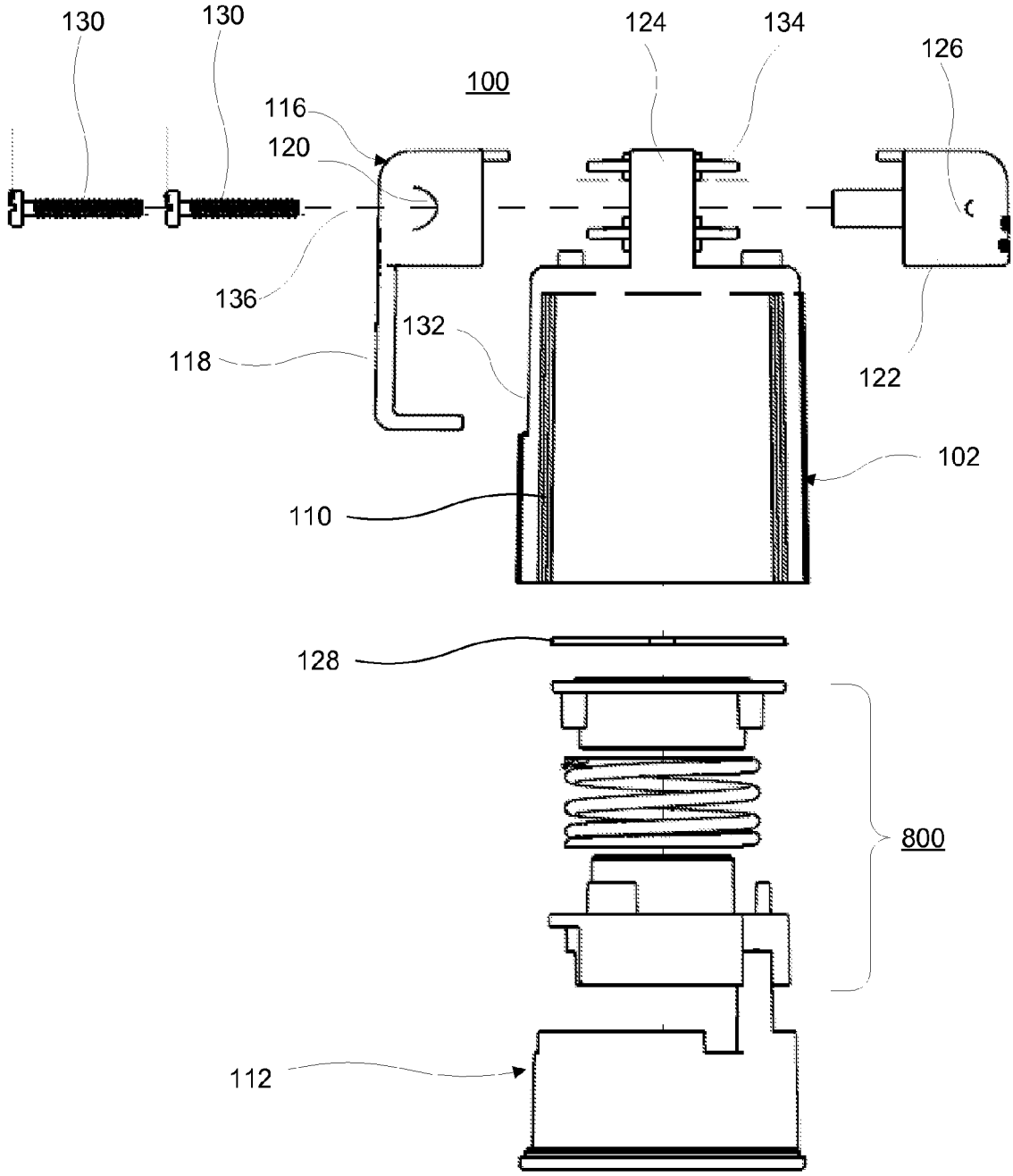
FIG. 1*b* is an exploded view of the rotatably locking plug connector of FIG. 1*a* according to certain exemplary embodiments of the present invention.

FIG. 1*b* is an exploded view of the rotatably locking plug connector 100 of FIG. 1*a* according to certain exemplary embodiments of the present invention. Turning now to FIG. 1*b*, the housing 102 is shown disassembled from its various component parts. The housing includes a depression 132 configured to accept the locking tab 118 such that the locking tab lays substantially flush with the housing 102 when the locking member 116 is engaged with the housing 102. The lock support members 124 extend substantially orthogonally from the top of the housing 102. The lock support members 124 include members 134 extend orthogonally from the lock support members 124 and engage the locking member 116 and the cable lock 122 to further support the cable lock 122 and the locking member 116 when engaged with the lock support members 124.

The locking member 116 and cable lock 122 include fastener openings 120 and 126, respectively. The fastener openings 120,126 accept fasteners 130 that are inserted along axis 136 through the locking member 116, the lock support member 124, and the cable lock 122. In one exemplary embodiment, the fasteners 130 are screws. In an alternative exemplary embodiment, the fasteners can be any suitable fastening means such as, but not limited to, nails, rivets, bolts, pins, or other fastening means.

In an exemplary embodiment, the housing 102 includes a gasket 128. The gasket 128 is configured to fit within the housing 102 and provide an opening (not shown) configured to fit around a conductor 108. The gasket 128 is formed from rubber or other material with elastic properties. The gasket 128 can provide a seal around the conductor 108 to prevent foreign materials such as dirt, sand, or other materials from entering the rotatably locking connector 100.

As will be described in further detail with respect to FIG. 8, the housing 102 also includes a spacer 800. The spacer 800 engages the locking ring 112, as will be described in further detail below with respect to FIGS. 7 and 8.

Figure 2:
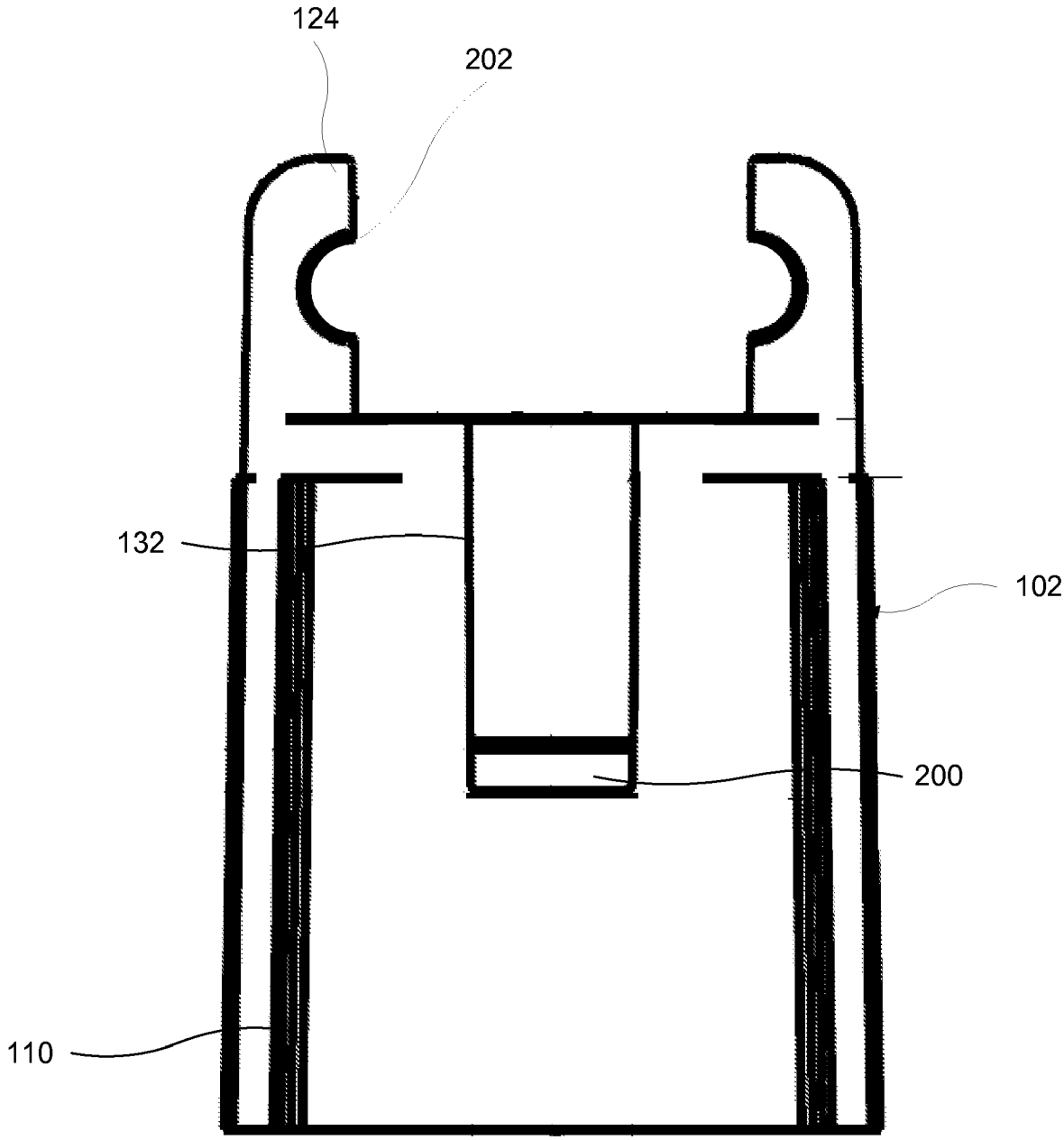
FIG. 2 is a side view of a housing of the rotatably locking plug connector of FIG. 1*a* according to certain exemplary embodiments of the present invention.

FIG. 2 is a side view of the housing 102 of the rotatably locking plug connector 100 of FIG. 1*a* according to certain exemplary embodiments of the present invention. Turning now to FIG. 2, the housing includes a depression 132 for accepting the locking tab 118 (FIG. 1*b*), allowing it to lay flush with the housing 102 when the locking member 116 is engaged with the housing 102. The depression 132 also includes an aperture 200 configured to accept an end of the locking tab 118. The aperture 200 and its interaction with the locking tab 118 will be described in further detail below with respect to FIG. 5.

In one exemplary embodiment, the lock support members 124 include openings 202. The openings 202 are configured to engage the fastener passage 500 (FIG. 5) and provide additional support to the locking member 116 and the cable lock 122. The exemplary openings 202 are circular and configured to match the shape of the fastener passage 500. In an alternative exemplary embodiment, the openings 202 are any suitable shape and size to allow fasteners to pass through the locking member 116 and the cable lock 122 and support the locking member 116 and the cable lock 122 on the housing 102.

Figure 3:
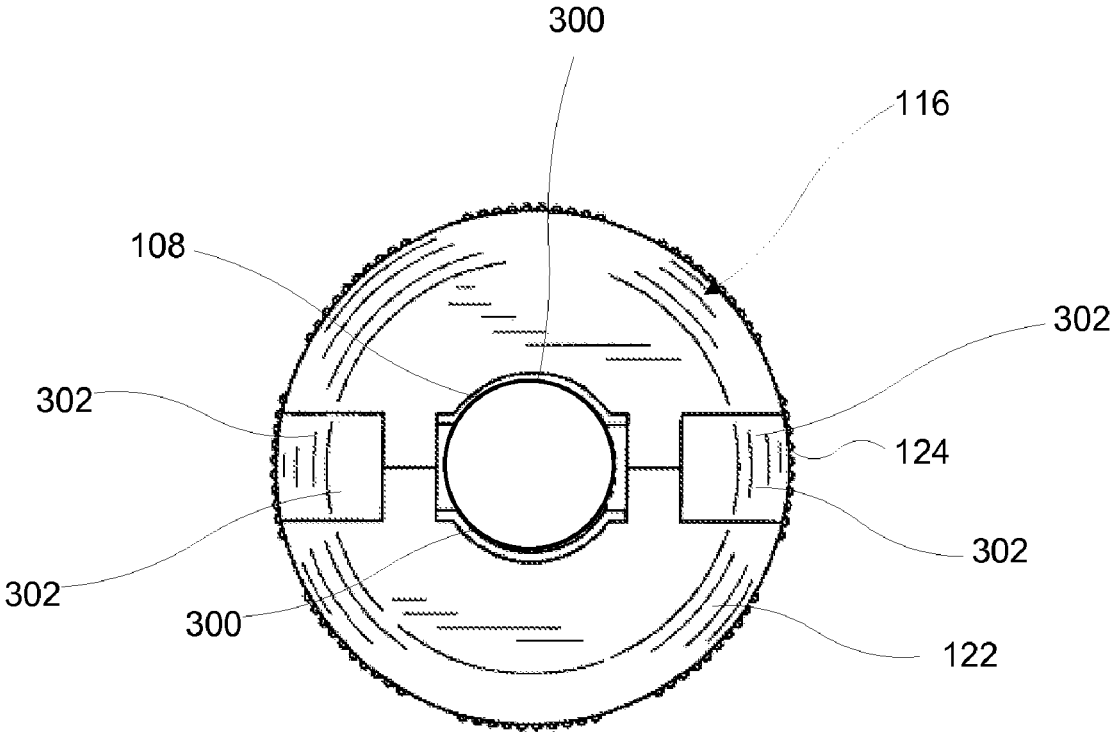
FIG. 3 is a top view of the rotatably locking plug connector of FIG. 1*a* according to certain exemplary embodiments of the present invention.

FIG. 3 is a top view of the rotatably locking plug connector 100 of FIG. 1*a* according to certain exemplary embodiments of the present invention. Turning now to FIG. 3, additional features of the locking member 116 and the cable lock 122 are illustrated. In one exemplary embodiment, the locking member 116 and the cable lock 122 are substantially semicircular in shape, with apertures 300,302 corresponding to the conductor 108 and the lock support members 124. In one exemplary embodiment, when the locking member 116 and the cable lock 122 are coupled together, a clamping force is applied to the conductor 108, as described above with respect to FIGS. 1 and 2. In an alternative embodiment, the locking member 116 and the cable lock 122 can be any shape that accomplishes the objectives described herein, so long as the interior provides apertures, openings, bore holes, or other accommodations for the lock support members 124 and the conductor 108.

Figure 4:
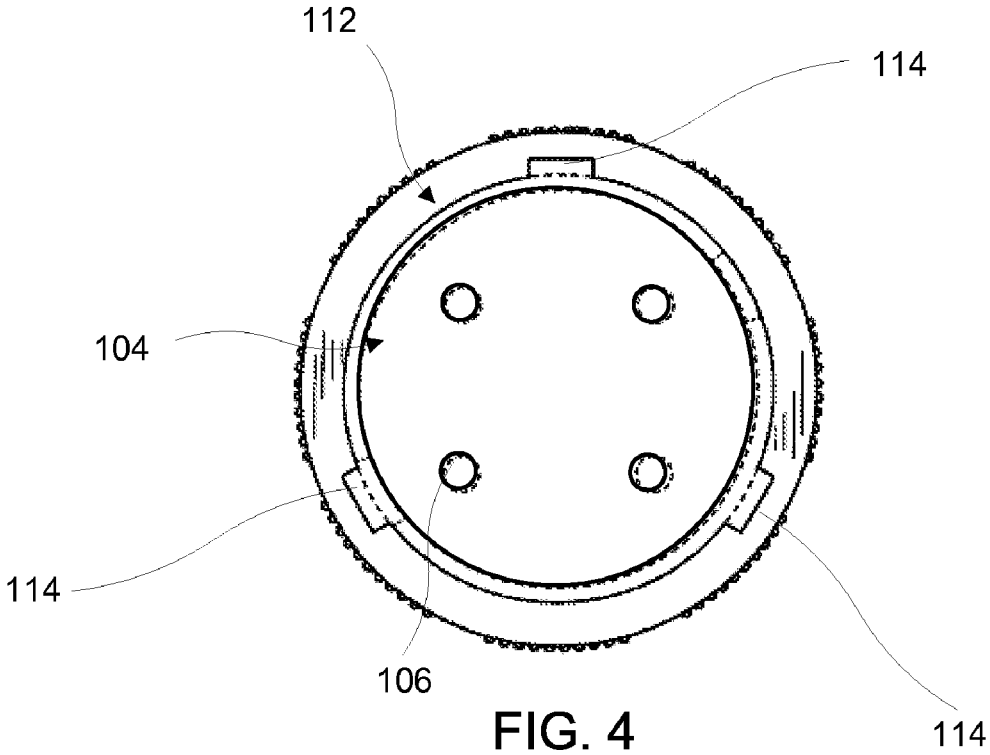
FIG. 4 is a bottom view of the rotatably locking plug connector of FIG. 1*a* according to certain exemplary embodiments of the present invention.

FIG. 4 is a bottom view of the rotatably locking plug connector 100 of FIG. 1*a* according to certain exemplary embodiments of the present invention. Turning now to FIG. 4, the locking ring 112 is illustrated. The locking ring 112 includes channels 114 that allow the electrical connector 104 to engage the housing 102. In one exemplary embodiment, the locking ring 112 has three channels 114, disposed equidistant from one another, which results in each channel 114 forming a 120 degree angle with each other channel 114 when measured from the center of the housing 102. In an alternative embodiment, the locking ring 112 can have any number of channels 114, which need not be disposed equal distances from one another.

Figure 5:
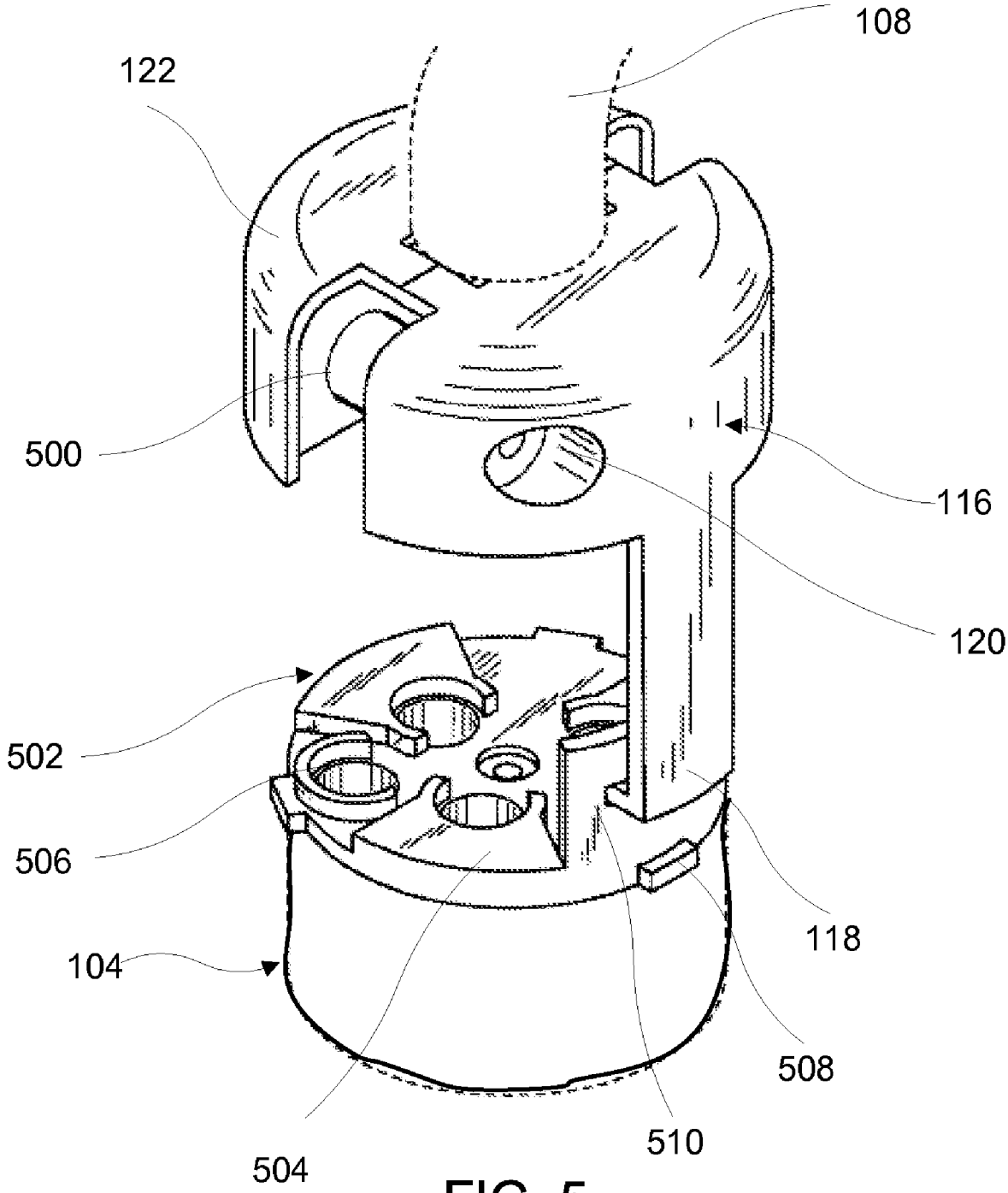
FIG. 5 is a perspective view of a locking mechanism for the rotatably locking plug connector of FIG. 1*a* according to certain exemplary embodiments of the present invention.

FIG. 5 is a perspective view of a locking mechanism for the rotatably locking plug connector 100 of FIG. 1*a* according to certain exemplary embodiments of the present invention. Turning now to FIG. 5, further details of the locking member 116 and cable lock 122 are illustrated. The cable lock 122 includes a fastener passage 500 that extends from the cable lock 122 in a substantially perpendicular direction to the longitudinal direction of the locking plug connector 100 and engages the locking member's 116 fastener openings. The fastener passage 500 provides two functions. First, the fastener passage 500 provides additional material for the fastener to engage, thus resulting in a more secure coupling between the cable lock 122 and the locking member 116. Second, the fastener passage 500 engages correspondingly curved portions on the lock support members 202 (FIG. 2), to further secure the cable lock 122 and locking member 116 to the housing 102.

A locking tab 118 extends longitudinally along the exterior of the housing 102 from the locking member 116. In one exemplary embodiment, the locking tab 118 is configured to extend from the locking member 116 along the side of the housing 102 within the depression 132 (FIG. 1*a*), as discussed above with respect to FIG. 1*a*, and to bend substantially ninety degrees at its end. The end of the locking tab 118 extends through an aperture 200 (FIG. 2) in the wall of the housing 102 and engages with the locking aperture 510 of the back cap 502.

The back cap 502 is coupled to the electrical connector 104 and facilitates the connection between the electrical connector 104 and the housing 102, as well as the connection between the electrical connector 104 and the locking tab 118. The back cap 502 is fastened to the electrical connector 104 by conventional fastening means, including, but not limited to, rivets, screws, and/or welds. The back cap 502 includes cable apertures 506 that allow strands of the conductor 108 to pass through the back cap 502 and be coupled to the electrical connector 104. In one exemplary embodiment, the back cap 502 includes four cable apertures 506, each of which corresponds to one strand of a four-conductor cable. In an alternative embodiment, the back cap 502 may have as many cable apertures 506 as the electrical connector 104 has blades. In an additional alternative embodiment, the back cap 502 may have a single cable aperture 506.

The back cap 502 also includes spacer engagement surfaces 504. The spacer engagement surfaces 504 provide level engagement with the spring-loaded spacer 800 that provides the force to lock the electrical connector 104 in place. The spacer engagement surfaces 504 provide stability that prevents the electrical connector 104 from rocking or wobbling when the electrical connector 104 is engaged with the spacer 800 (of FIG. 8). The spacer 800 will be discussed in greater detail with respect to FIG. 8. In one exemplary embodiment, the back cap 502 includes three spacer engagement surfaces 504, each of which is disposed opposite a tab 508. In an alternative embodiment, the spacer engagement surfaces 504 can be disposed in any arrangement as to provide a suitably stable interface between the back cap 502 and the spacer 800.

The back cap 502 also includes a locking aperture 510, which is configured to receive the end of the locking tab 118. When the electrical connector 104 is engaged with the housing 102, the locking aperture 510 lines up with the aperture 200 in the wall of the housing 102. The locking tab 118 then engages both the aperture 200 in the wall of the housing 102 and the locking aperture 510. When the locking tab 118 is engaged with the locking aperture 510, the electrical connector 104 cannot be moved with respect to the housing 102. In an alternative exemplary embodiment, other means of preventing the electrical connector 104 from rotating can be used. For example, an opening of any suitable size and shape in the electrical connector 104 can be matched with an opening in the housing 102 such that the openings are aligned when the electrical connector 104 is in place. Then a pin or other solid member can be inserted through the openings, holding the electrical connector in place.

The back cap 502 also includes tabs 508 for engaging the locking ring 112. The tabs 508 extend radially out from the exterior of the back cap 502. In one exemplary embodiment, the back cap 502 includes three tabs 508 (corresponding to the three channels 114 as described with respect to FIG. 4), each disposed an equal distance from the other tabs 508. The tabs 508 are substantially rectangular, and are shaped to firmly engage the channels 114. In an alternative embodiment, there can be any number of tabs 508, which can be disposed in any suitable arrangement around the back cap 502, so long as the tabs 508 correspond to the channels 114 of the locking ring 112. The tabs 508 can be of any shape so long as they can slidably engage the channels 114 and are sufficiently rigid to support the electrical connector 104 when it is rotatably engaged with the housing 102.

Figure 6:
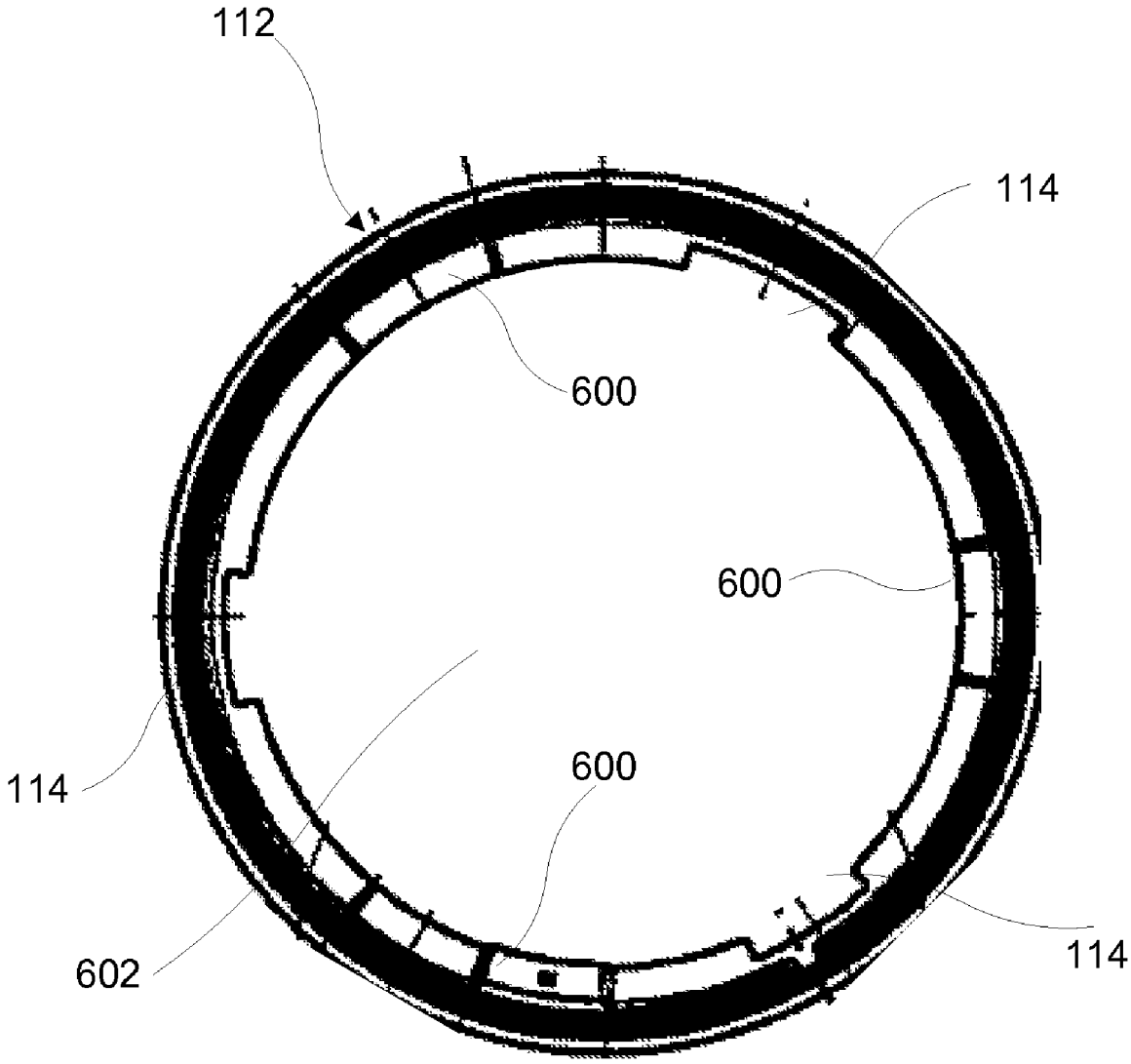
FIG. 6 is a bottom view of a locking ring for the rotatably locking plug connector of FIG. 1*a* according to certain exemplary embodiments of the present invention.

FIG. 6 is a bottom view of a locking ring 112 for the rotatably locking plug connector 100 of FIG. 1*a* according to certain exemplary embodiments of the present invention. Turning now to FIG. 6, the channels 114, as previously discussed with respect to FIGS. 1, 2, and 4, are shown. In one exemplary embodiment, the channels 114 are disposed longitudinally along the interior portion of the locking ring 112 and are substantially rectangular indentations along the interior of the locking ring 112. The channels 114 allow the back cap tabs 508 to pass through the locking ring 112, thus allowing the electrical connector 104 to engage the housing 102. In an alternative embodiment, the channels 114 may be disposed in a substantially spiral configuration along the interior of the locking ring 112. In this embodiment, the back cap tabs 508 move through the locking ring 112 by rotating the electrical connector 104, causing the back cap tabs 508 to move through the locking ring 112. Thus, by way of example only, the back cap tabs 508 act similarly to a conventional threaded screw engaging a correspondingly threaded nut.

The locking ring 112 includes an opening 602 that is configured to allow the electrical connector 104 to pass through the locking ring 112. In one exemplary embodiment, the locking ring 112 is configured such that the electrical connector 104 can only pass through when the tabs 508 are aligned with the channels 114.

The locking ring 112 also includes tab retention members 600. In one exemplary embodiment, the tab retention members 600 are sized and shaped substantially similarly to the channels 114. However, unlike the channels 114, the tab retention members 600 only extend a partial distance through the locking ring 112. Accordingly, when the electrical connector 104 is rotated such that the tabs 508 are aligned with the tab retention members 600, the electrical connector 104 can only move into the locking ring 112, where the tabs 508 are then trapped in the tab retention members 600. By applying an upward force on the electrical connector 104 with the spacer 800 (of FIG. 8), as will be described in further detail below with respect to FIG. 8, the electrical coupler cannot be moved with respect to the housing 102 until the electrical connector 104 is moved out of the tab retention members 600 (for example, by applying a force in the opposite direction of the spacer's spring force) and rotating the electrical coupler such that the tabs 508 realign with the channels 114.

Figure 7:
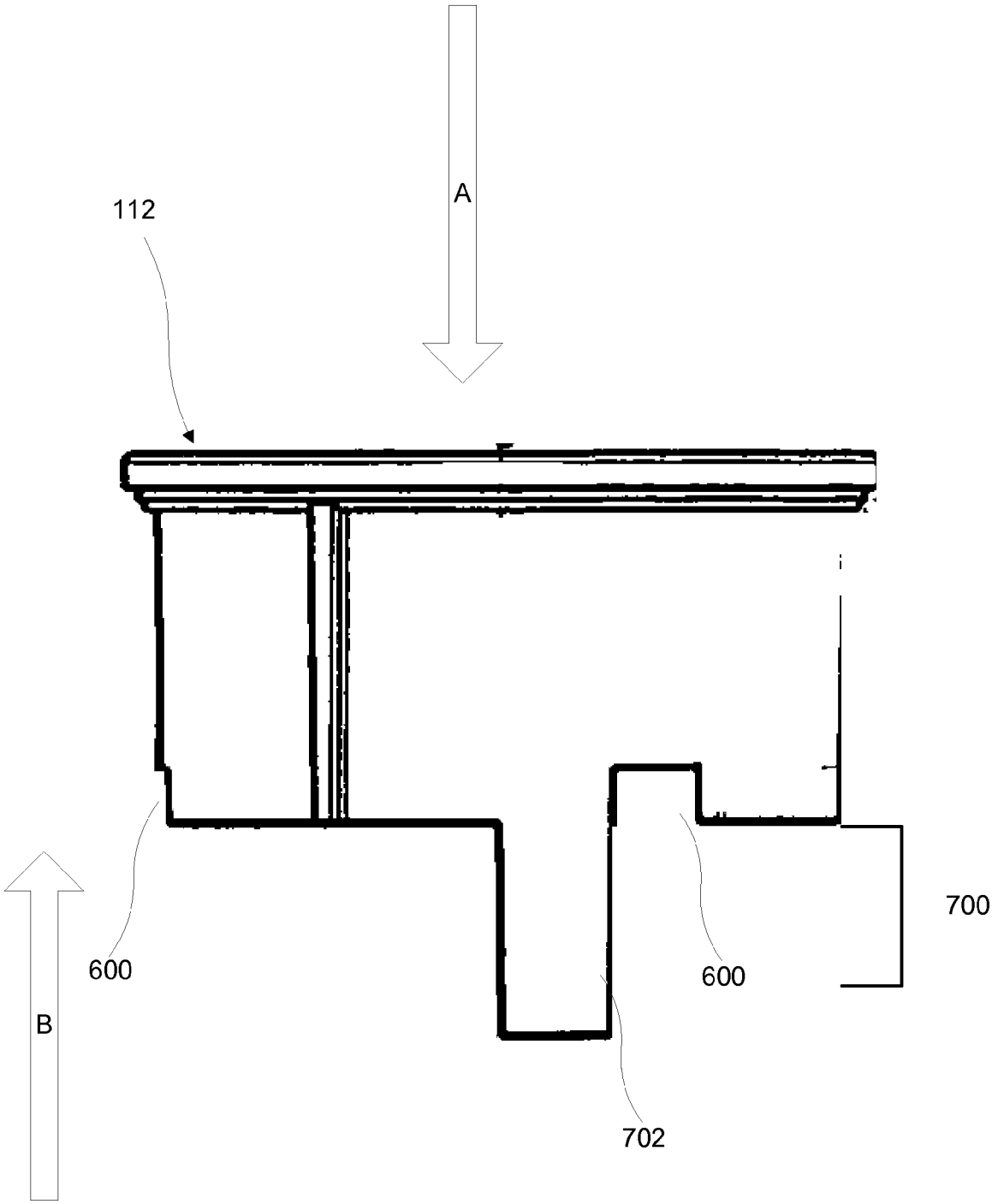
FIG. 7 is a side view of the locking ring of FIG. 6 according to certain exemplary embodiments of the present invention.

FIG. 7 is a side view of the locking ring 112 of FIG. 6 according to certain exemplary embodiments of the present invention. Referring now to FIGS. 1, 5, 6, and 7, the tab retention members 600 are shown. In one exemplary embodiment, the tab retention members 600 are apertures in the locking ring 112. When the locking ring 112 is fused to the housing 102, however, the tab retention members 600 are similar to the channels 114, although slightly deeper. In an alternative embodiment, the tab retention members 600 need not result in openings through the entire wall of the locking ring 112, making the depth of the tab retention members 600 closer to that of the channels 114.

As illustrated in FIG. 7, when the electrical connector 104 is passed through the locking ring 112 (in direction A), the tabs 508 eventually emerge in the rotation region 700. Once there, the tabs 508 are free from the channels 114, and the electrical connector 104 can be rotated with respect to the locking ring 112 until the tabs 508 are aligned with the tab retention members 600. Once the tabs 508 are aligned with the tab retention members 600, the spring-loaded spacer 800 (of FIG. 8) exerts a force (in direction B), which presses the tabs 508 into the tab retention members 600, holding the tabs 508 (and therefore the electrical connector 104) in place until sufficient force is exerted in direction A to overcome the spring force in direction B. Once overcome, the tabs 508 will emerge from the tab retention members 600 into the rotation region 700, where the electrical connector 104 can be rotated such that the tabs 508 align with the channel 114, allowing the electrical connector 104 to be removed from the housing 102.

The locking ring 112 also includes a tab stop member 702, which, in one exemplary embodiment, serves two purposes. First, the tab stop member 702 assists in the alignment of the tabs 508 with the tab retention members 600. As illustrated in FIG. 7, the tab stop member 702 is located in the rotation region 700 directly adjacent to a tab retention member. As the electrical connector 104 is rotated with respect to the housing 102, one of the tabs 508 will ultimately come in contact with the tab stop member 702, thereby preventing further rotation. When an individual rotating the electrical connector 104 in an effort to engage the tabs 508 in the tab retention members 600 senses that the electrical connector 104 can no longer be rotated, the individual may simply release or reduce pressure on the electrical connector 104 with confidence that the tabs 508 are aligned with the tab retention members 600. Second, the tab stop member 702 acts as a guide to the spacer 800, preventing it from rotating with respect to the housing 102, as will be described with respect to FIG. 8.

Figure 8:
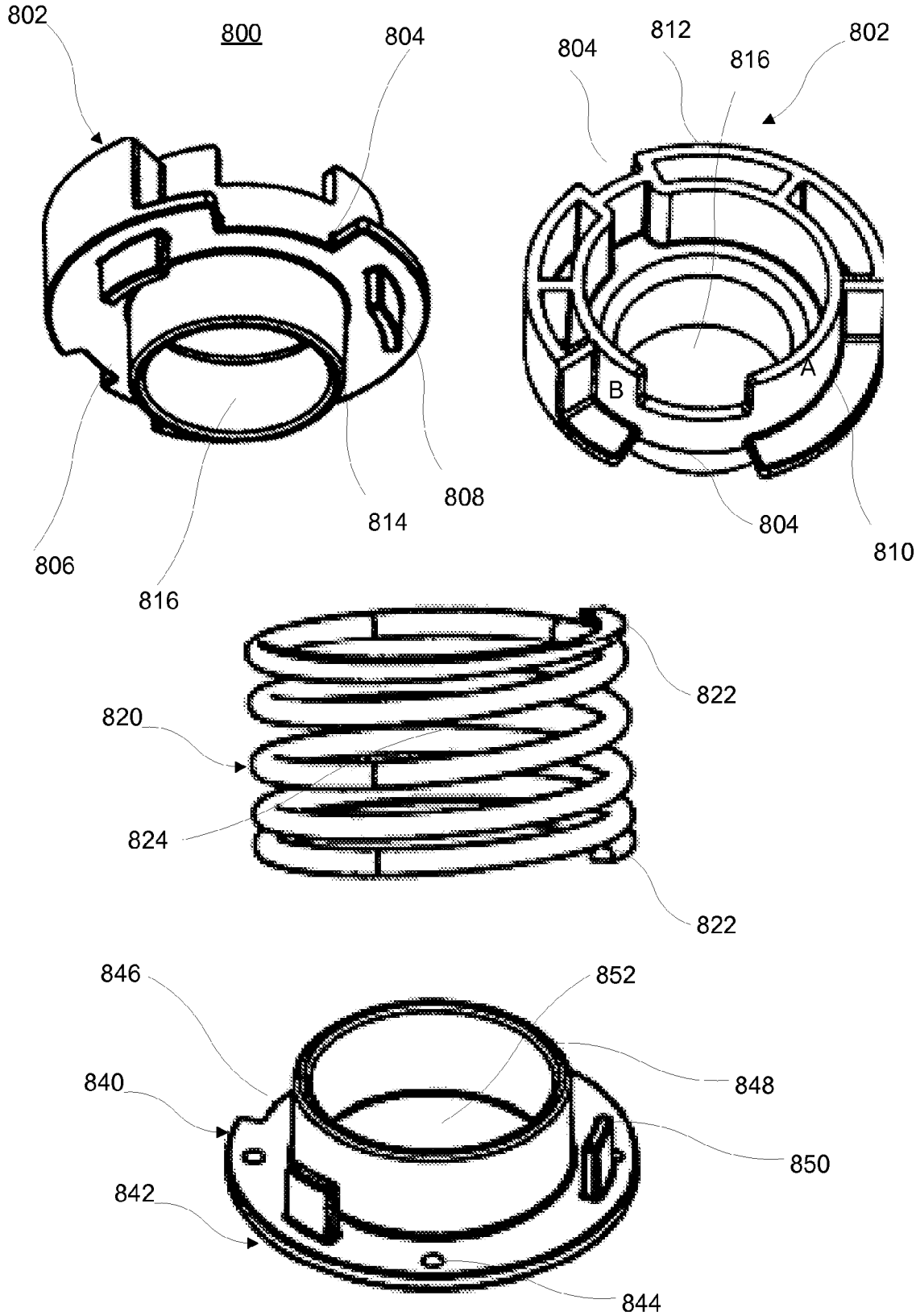
FIG. 8 is an exploded view of a spacer for the rotatably locking plug connector of FIG. 1*a* according to certain exemplary embodiments of the present invention.

FIG. 8 is an exploded view of the spacer 800 for the rotatably locking plug connector 100 of FIG. 1*a* according to certain exemplary embodiments of the present invention. Turning now to FIG. 8, the spacer 800 includes a back cap engagement member 802 that engages the back cap 502, a housing engagement member 840 that engages the housing 102, and a spring 820 that is positioned between the housing engagement member 840 and the back cap engagement member 802 and is biased to exert a force on each, such that the housing engagement member 840 and the back cap engagement member 802 are forced away from one another. The back cap engagement member 802, the spring 820, and the housing engagement member 840 all include apertures 816, 824,852 to allow the conductor (not shown) to extend from the electrical connector 104, through the spacer 800, and out of the housing 102.

The back cap engagement member 802 includes a first positioning aperture 804 that is configured to engage the housing 102. In an exemplary embodiment, the depression described above with respect to FIG. 1*a* has a corresponding protrusion (not shown) on the inside of the housing 102. The first positioning aperture 804 is configured to engage the protrusion such that the back cap engagement member 802 can slide along the protrusion's length, but cannot move rotationally with respect to the housing 102.

The back cap engagement member 802 includes a second positioning aperture 806 that is configured to engage the tab stop member 702. In one exemplary embodiment, the second positioning aperture 806 is disposed in a location along the outside of the back cap engagement member 802 such that the second positioning aperture 806 engages the tab stop member 702 when the first positioning aperture 804 is engaged with the protrusion as described above. The second positioning aperture 806 is configured to engage the tab stop member 702 such that the back cap engagement member 802 can slide along the tab stop member's 702 length, but cannot move rotationally with respect to the housing 102.

The back cap engagement member 802 also includes a locking aperture receptor 810. The locking aperture receptor 810 is configured to receive the locking aperture 510 in position A when the electrical receptacle is engaged with the locking ring 112 (of FIG. 1*a*) such that the tabs 508 (of FIG. 5) are aligned with the channels 114 (of FIG. 1*a*), and to allow the locking aperture 510 (of FIG. 5) to be rotated to position B when the tabs 508 are aligned with the tab retention members 600 (of FIG. 6).

The back cap engagement member 802 also includes a back cap interface 812. In one exemplary embodiment, the back cap interface 812 is a sufficiently flat surface disposed along the top portion of the engagement member 802 to interface with the spacer engagement surface 504 on the back cap 502 (of FIG. 5). The back cap engagement member 802 also includes spring retention members 808,814. In one exemplary embodiment, the spring retention members include a circular member 814 that is configured to fit within the interior portion of the spring 820 along with one or more members 808 extending longitudinally from the back cap engagement member 802. The members 808,814 are disposed to engage the outer portion of the spring 820, thus positioning a portion of the spring between the circular member 814 and the members 808 and holding the spring 820 in place when compressed.

The housing engagement member 840 includes a base 842 that is configured to engage the housing 102 (of FIG. 1*a*) at the end opposite the electrical connector 104. In one exemplary embodiment, the base is shaped to fit within the interior of the housing 102. The base 842 includes peg apertures 844 that are configured to engage pegs (not shown) that extend from the housing 102 to prevent the housing engagement member 840 from rotating. The housing engagement member 840 also includes a positioning aperture 846 that is configured similarly to the first positioning aperture 804 of the back cap engagement member 802, in that the positioning aperture 846 is shaped to engage the protrusion corresponding to the depression 132 (FIG. 2) on the housing 102. The housing engagement member 840 also includes spring retention members 848,850. The members 850 extend longitudinally from the base 842 and are disposed to engage the outer portion of the spring 820, thus positioning a portion of the spring between the circular member 848 and the members 850, thus holding the spring 820 in place when compressed.

The spring 820 is disposed between the back cap engagement member 802 and the housing engagement member 840. The spring 820 is biased such that it exerts a force on the back cap engagement member 802 towards the electrical connector 104 to facilitate the trapping of the tabs 508 (of FIG. 5) in the tab retention members 600, as described above with respect to FIG. 7. The spring 820 has flattened ends 822 where the spring 820 engages the back cap engagement member 802 and the housing engagement member 840. In one exemplary embodiment, the spring 820 is a steel coil compression spring that exerts a maximum of 15 pounds of force. In an alternative embodiment, the spring 820 can be any device having spring-like properties, such as, but not limited to pneumatic cylinders, leaf springs, or other similar devices.

Figure 9:
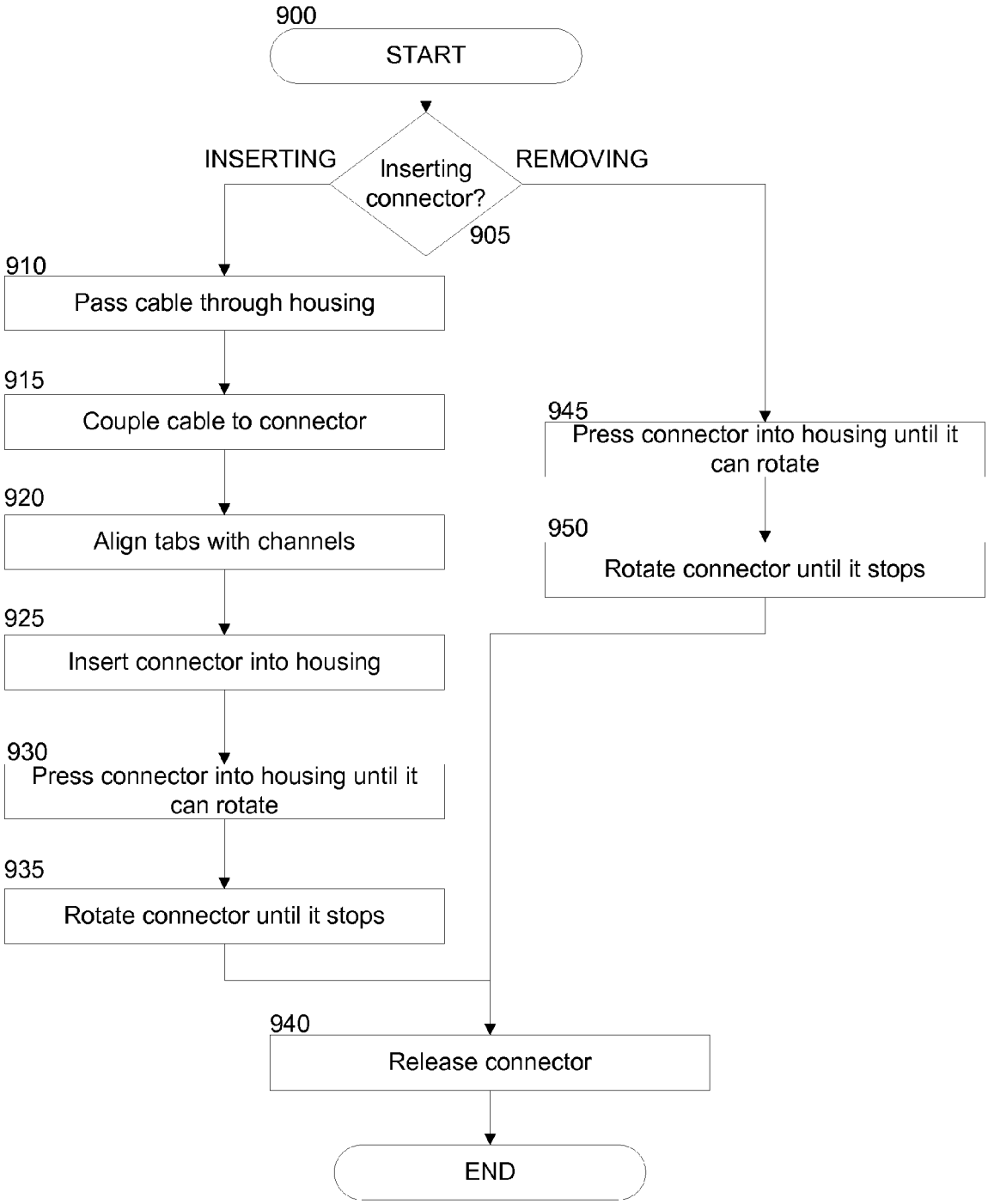
FIG. 9 is a flowchart describing a method for locking and unlocking the rotatably locking plug connector of FIG. 1*a* according to certain exemplary embodiments of the present invention.

FIG. 9 is a flowchart describing a method 900 for locking and unlocking the rotatably locking plug connector 100 of FIG. 1*a* according to certain exemplary embodiments of the present invention. The method 900 will be described with reference to the structure described in FIGS. 1-8. Certain steps in the process flow of FIG. 9 must naturally precede others for the invention to function as described. However, the invention is not limited to the order of the steps described if such order or sequence does not alter the functionality of the present invention. That is, it is recognized that some steps may be performed before, after, or in parallel with other steps without departing from the scope and spirit of the present invention.

Additionally, it is recognized that certain steps could be re-arranged in different sequences or entirely deleted without deviating from the scope and spirit of the invention. In other words, it is recognized that the steps illustrated in the flowchart represent one way of locking and unlocking a rotatably locking plug connector. Other ways which may include adding different steps, eliminating steps, or a combination of eliminating steps and adding different steps will be apparent to one of ordinary skill in the art.

Referring now to FIGS. 1-8 and 9, the exemplary method 900 begins at the START step and proceeds to step 905, it is determined whether an electrical connector 104 is being inserted or removed from a housing 102. If the electrical connector 104 is being inserted, the method follows the "INSERTING" branch to step 910, where an electrical cable 108 is passed through the housing 102. In step 915, the cable 108 is coupled to an electrical connector 104. In one exemplary embodiment, the electrical connector 104 is configured as described above, and is coupled to a back end cap 502.

In step 920, the tabs 508 are aligned with the channels 114. In step 925, the electrical connector 104 is inserted in the housing 102, wherein the tabs 508 engage the channels 114. The electrical connector 104 is pressed into the housing 102 in step 930. By pressing the electrical conductor 104 into the housing 102, the spring 820 is compressed, which allows the tabs 508 to move down through and then out of the channels 114 and into the rotation region 700. Once the tabs 508 move into the rotation region 700, the electrical connector 104 can be rotated with respect to the housing 102.

In step 935 the electrical connector 104 is rotated. In one exemplary embodiment, the rotation continues until one of the tabs 114 encounters the tab stop member 702. At that point, further rotation of the electrical connector 104 is prevented, signaling to the individual rotating the electrical connector 104 that the tabs 114 are aligned with the tab retention members 600. In step 940, any force being applied to the electrical connector 104 is released. By releasing the force on the electrical connector 104, the spring 820 is allowed to return to its natural shape, which presses the tabs 508 into the tab retention members 600, holding the electrical connector 104 in place. The method 900 then continues to the END step.

Turning to step 905, if it is determined that the electrical connector 104 is being removed from the housing 102, the method 900 follows the "REMOVING" branch to step 945. The "REMOVING" branch presumes that the electrical connector 104 is already locked in the housing 102 (as described in steps 910 through 940). In step 945, the electrical connector 104 is pressed into the housing 102. By pressing the electrical connector 104 into the housing, the spring 820 is compressed, allowing the tabs 508 to move downward and out of the tab retention members 600 and into the rotation region 700. Once the tabs 508 are in the rotation region 700, the electrical connector 104 can be rotated with respect to the housing 102.

The electrical connector 104 is rotated in step 950. In one exemplary embodiment, the electrical connector 104 is rotated in a direction opposite to the direction of rotation in step 935. As the electrical connector 104 is rotated, the locking aperture 510 comes into contact with an end of the locking aperture receptor 810 (position A in FIG. 8), preventing further rotation. Further, when the locking aperture 510 is in contact with an end of the locking aperture receptor 810, the tabs 508 are aligned with the channels 114. When the electrical connector 104 can no longer be rotated, the individual rotating the electrical connector 104 receives notice or is capable of determining that the tabs 508 are aligned with the channels 114. In step 940, the individual releases the electrical connector 104, which allows the tabs to move up through the channels 114, in part by the force exerted by the spring 820, so that the electrical connector 140 can then be removed from the housing 102.

Figure 10:
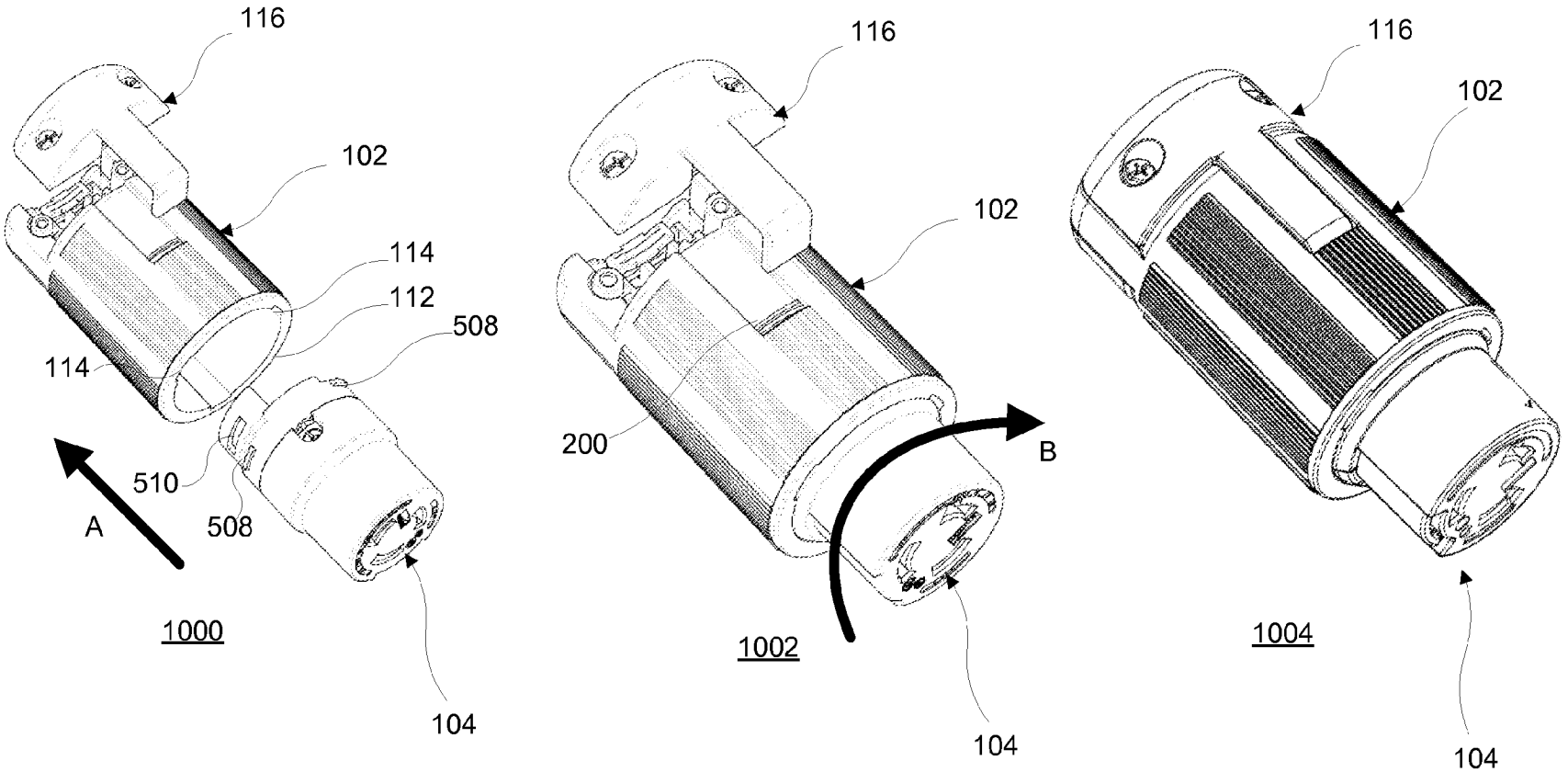
FIG. 10 is an illustration of the process of locking the rotatably locking plug connector of FIG. 1*a* according to certain exemplary embodiments of the present invention.

FIG. 10 is an illustration of the process of locking the rotatably locking plug connector 100 of FIG. 1*a* according to certain exemplary embodiments of the present invention. In step 1000, the electrical connector 104 is disposed such that the back cap tabs 508 are aligned with the channels 114. The electrical connector 104 is then moved in direction A into the housing 102. Force is exerted in direction A to overcome the spring force exerted by the spacer 800 (not shown). In step 1002, the electrical connector 104 is rotated in direction B. This moves the back cap tabs 508 into alignment with the tab retention members 600 (FIG. 6). This also brings the aperture 200 in line with the locking aperture 510. In step 1004, the locking member is inserted into the housing 102, thus locking the electrical connector 104 in place.

Based on the foregoing, it can be seen that the present invention provides a rotatably locking plug and connector. It can further be seen that the present invention provides a method for locking and unlocking a rotatably locking plug connector. Many other modifications, features and embodiments of the present invention will become evident to those of ordinary skill in the art. It should be appreciated, therefore, that many aspects of the present invention were described above by way of example only and are not intended as required or essential elements of the invention unless explicitly stated otherwise. Accordingly, it should be understood that the foregoing relates only to certain exemplary embodiments of the invention and that numerous changes can be made therein without departing from the spirit and scope of the invention as defined by the following claims.

What is claimed is:

1. An apparatus for coupling an electrical connector to a cable, comprising:

an electrical connector comprising at least one tab extending radially out from the electrical connector;

a housing rotatably coupled to the electrical connector, the housing comprising:

at least one first channel disposed along an interior of the housing, wherein the at least one tab is configured to slidably engage the first channel;

a spacer applying a first force in a first direction to the electrical connector;

at least one tab retention member disposed along the interior of the housing, wherein the tab retention member is annularly disposed from the first channel and prevents the electrical connector from traveling beyond a predetermined distance in the first direction;

at least one second channel for slidably receiving the at least one tab, the at least one second channel transverse the first channel and the tab retention member;

wherein a second force is applied in a second direction for each of the at least one tabs to transition from the first channel to the second channel; and wherein the first force applied by the spacer holds the electrical connector in place against the tab retention member.

2. The apparatus of claim 1, further comprising a cable electrically coupled to the electrical connector.

3. The apparatus of claim 1, wherein the first channels, second channels and tab retention members are disposed on a locking member, said locking member coupled to the housing.

4. The apparatus of claim 1, wherein the electrical connector further comprises a member comprising a locking aperture, the member extending from the electrical connector in a direction substantially orthogonal to the at least one tab.

5. The apparatus of claim 4, wherein the housing further comprises an aperture disposed along a wall of the housing;

wherein the aperture and the locking aperture are substantially aligned when the at least one tab is disposed against the at least one tab retention member.

6. The apparatus of claim 5, further comprising a locking tab releasably coupled along a first end to the housing and comprising a second end slidably inserted into the aperture and the locking aperture.

7. The apparatus of claim 1, wherein the tab retention member comprises a third channel disposed substantially orthogonal to the second channel.

8. The apparatus of claim 7, wherein the first channels and the third channels are substantially parallel.

9. A method for coupling an electrical connector to a cable, comprising:

providing a housing configured to receive an electrical connector, the housing comprising:

a spacer applying a first force in a first direction;

a first channel disposed along an interior of the housing;

a tab retention member disposed along the interior of the housing; and a second channel transverse the first channel and the tab retention member;

providing an electrical connector comprising a tab;

aligning the tab with the first channel;

slidably moving the tab in the first channel in a second direction;

applying a second force in the second direction on the electrical connector, the second force displacing the spacer in the second direction and providing access to the second channel;

rotating the tab in a first direction along the second channel into alignment with the tab retention member;

reducing the second force on the electrical connector; and displacing the tab in the first direction and into contact with the tab retention member.

10. The method of claim 9, wherein the rotating step comprises rotating the electrical connector until it stops.

11. The method of claim 9, wherein the spacer comprises a spring.

12. The method of claim 11, wherein the displacing step comprises applying force to the electrical connector with the spring.

13. The method of claim 9, further comprising decoupling the electrical connector from the housing, comprising the steps of:

applying a third force in the second direction on the electrical connector, the third force displacing the spacer in the second direction and providing access to the second channel;

rotating the tab in a second direction along the second channel into alignment with the first channel.

14. The method of claim 13, further comprising removing the electrical connector from the housing.

15. A system for protecting an electrical coupling between an electrical connector and a conductor, the system comprising:

a housing configured to protect the electrical coupling, the housing comprising:

a spacer comprising a spring and configured to apply a force in a first direction against the electrical connector; and a locking ring configured to prevent the electrical connector from passing into the housing, comprising:

a channel configured to allow the electrical connector to pass into the housing when the electrical connector is disposed in a first orientation with respect to the housing; and a retention member configured to hold the electrical connector within the housing when the electrical connector is disposed in a second orientation with respect to the housing.

16. The system of claim 15, wherein the housing further comprises:

a locking member disposed on the housing and configured to engage the electrical connector, wherein the locking member holds the electrical connector in place when engaged with the electrical connector.

17. The system of claim 16, wherein the housing further comprises an aperture to accommodate the locking member.

18. The system of claim 16, wherein the electrical connector further comprises an aperture to accommodate the locking member.

19. The system of claim 16, wherein the housing further comprises:

a cable lock disposed on the housing and fastened to the locking member, wherein the cable lock and the locking member apply a clamping force to the conductor.

* * * * *